United States Patent [19]

Takamizawa et al.

[11] Patent Number: 4,864,959

[45] Date of Patent: Sep. 12, 1989

[54] AQUASCOOTER

[75] Inventors: Nobuyuki Takamizawa, Machida; Tetsuo Yoshizawa, Nakano; Susumu Shirai, Kamitakai, all of Japan

[73] Assignee: Apollo Sports Co., Ltd., Ebina, Japan

[21] Appl. No.: 179,938

[22] Filed: Apr. 11, 1988

[30] Foreign Application Priority Data

Feb. 2, 1988 [JP] Japan ..... 63-22367

[51] Int. Cl.[4] ..... B63C 11/46

[52] U.S. Cl. ..... 114/315; 340/605; 440/1; 440/6

[58] Field of Search ..... 440/1, 6; 114/315; 340/604, 605

[56] References Cited

U.S. PATENT DOCUMENTS

| | | | |
|---|---|---|---|
| 3,685,480 | 8/1972 | Peroni | 440/6 |
| 3,757,721 | 9/1973 | Ohishi | 114/315 |
| 3,789,788 | 2/1974 | Peroni | 114/315 |
| 3,890,920 | 6/1975 | Buelk | 114/315 |
| 4,312,580 | 1/1982 | Schwomma et al. | 340/605 |

*Primary Examiner*—Sherman D. Basinger
*Assistant Examiner*—Thomas J. Brahan
*Attorney, Agent, or Firm*—Cushman, Darby & Cushman

[57] ABSTRACT

An aquascooter apparatus including a controller for preventing problems associated with water leakage into the aquascooter. The aquascooter has a battery, a driving motor and a clutch in a housing, and the controller includes a water leak detecting sensor that detects a leakage of water into the housing. A motor control is responsive to the signal from the water leak detecting sensor, and prevents the battery from supplying electric power to the driving motor responsive to this signal. This prevents electrical energy from being used if a water leak is detected, and therefore prevents any possibility of a dangerous situation of a spark in contact with hydrogen gas.

14 Claims, 11 Drawing Sheets

63

15
36'
4
36
39

13
3
0
7
11
12a

AQUASCOOTER

BACKGROUND OF THE INVENTION

1. Field of the Invention

The present invention relates to an aquascooter which is designed to be used by a scubadiver in scubadiving and other underwater activities, and more particularly to an aquascooter which is guaranteed free of destruction by explosion of hydrogen which is produced from chemical reaction in battery or by electrolysis of seawater leaking into the scooter housing.

2. Description of the Prior Art

As is well known, aquascooters have been widely used by scubadivers in scubadiving and other underwater athletic activities. A conventional aquascooter generally comprises, in a housing with carrying handles, a battery, a driving motor and a power transmission to transmit driving power to a propeller, which appears out of the housing.

The housing of the conventional aquascooter has no partitions to define separate compartments each allotted to the battery, the driving motor and the power transmission. These different parts are together put in a single housing space. The battery is fixed to the housing.

The conventional aquascooter has no safety means to prevent hydrogen explosion. Hydrogen gas is produced from chemical reaction in the battery or by electrolysis by the battery of seawater leaking into the scooter housing. Hydrogen explosion is caused by spark for instance, appearing in the brush of the driving motor.

The conventional aquascooter has no means to absorb seawater leaking into the housing. Its housing ha only two carrying handles at opposite sides. A propeller shroud enclosing the propeller is of circular shape.

Such conventional aquascooters have been popular among scubadivers in scubadiving and other underwater activities for a long time. Scubadivers have been increasing, and their underwater activities with the aid of aquascooters must be guaranteed free of any danger. As mentioned above, the conventional aquascooter has no safety means to prevent hydrogen explosion, which is caused by exposing hydrogen gas to spark for instance, appearing in the brush of the driving motor. Such hydrogen gas is produced from chemical reaction in the battery or by electrolysis by the battery of seawater leaking into the scooter housing. Hydrogen explosion will break mechanical parts and aquascooter body, and there is a fear of injuring scubadivers. In fact, many accidents have been reported.

Leak of seawater into the housing will cause corrosion and damage of parts, reducing the endurance and safety of the aquascooter. The conventional aquascooter has no remedy for this problem.

Two handles of the aquascooter body may be convenient for carrying it by two persons on land. They stand on the opposite sides of the aquascooter, each of them to be held by one hand. However it is inconvenient for a single person to carry in his arms with both hands gripping the handles.

The round propeller shroud makes it difficult for a scubadiver to hold his body parallel to the aquascooter body in water.

Among these defects, the problem of hydrogen explosion is of greatest concern. Therefore, this must be discussed first.

Thermal reaction in hydrogen explosion is theoretically expressed by:

$$H_2+\tfrac{1}{2}\,O_2=H_2O+68.3\ K\ \text{cal}$$

When a mixture of hydrogen and air or oxygen is ignited, a chain of above reactions will be triggered, generating a large amount of heat instantaneously to cause steam to expand exlosively. This is called the hydrogen explosion. The chemical reaction is most vigorous when the hydrogen-to-air ratio is 2 to 5 in volume (approximately 29% in volume). The flammable range is from 4.1 to 74.2% in volume.

Now, the development of chemical reaction to explosion in an aquascooter is described below. First, the development of chemical reaction to explosion of hydrogen gas from a battery is described.

$$\underset{\text{(anode)}}{PbO_z} + 2H_2So_4 + \underset{\text{(cathode)}}{Pb} \underset{\text{charging}}{\overset{\text{discharging}}{\rightleftharpoons}} \underset{\text{(anode)}}{PbSo_4} + 2H_2O + \underset{\text{(cathode)}}{PbSo_4}$$

In the normal charging and discharging process in the battery, no hydrogen gas can be produced according to the theory. A small amount of hydrogen gas, in fact, appears when charging is completed, or when the battery is overcharged. When repeatedly used, a battery is apt to produce hydrogen gas. It has been found that if a battery is put in a closed space, hydrogen gas is produced and released from the battery until the atmosphere in the closed space reaches the explosion limit. The amount of hydrogen gas produced depends on the temperature of the battery and surrounding atmosphere. Specifically, no hydrogen gas is produced at 40 degrees C.; 7 to 15 cc/H at 60 degrees C,; 20 to 120 cc/H at 70 degrees C.; and 120 to 250 cc/H at 80 degrees C. Hydrogen yield increases as the temperature rises. The explosion limit will be reached in 10 to 20 hours at 60 degrees C; in 1.2 to 7.5 hours at 70 degrees C.; and in 0.6 to 1.2 hours at 80 degrees C. Explosion is caused when such flammable atmosphere is ignited by spark appearing in the brushes of an electric motor, in the contacts of relays and switches, or by flame appearing in wires and connectors when heated by heavy current flowing in these wires and connectors.

In the conventional aquascooter a battery is fixed in the housing, and therefore, the battery cannot be removed and will be repeatedly charged in situs of the closed space, thus accumulating hydrogen gas to the explosion limit in the housing. The battery, driving motor, clutch and wirings are contained together in the same housing space, and therefore if the temperature of the battery rises, the flammable hydrogen-to-air ratio being reached in a relatively short time at an increased temperature will be a great danger of hydrogen explosion, which may triggered by spark appearing in the electric system in the same housing space.

Another possibility of hydrogen explosion is found in hydrogen electrolysis by the battery of seawater, which leaks into the aquascooter housing.

In electrolysis of seawater, salt and other ingredients are chemically bound with hydroxyl ions to produce a large amount of hydrogen and chlorine gas. This chemical reaction is caused when the positive and negative terminals of the battery are submerged in seawater. When the flammable hydrogen-to-air ratio has been reached, and when spark appears in the flammable atmosphere, a hydrogen explosion will be caused. In fact, there were may explosions due to electrolysis of seawater because conventional aquascooters have no means to prevent leakage of seawater into the housing.

SUMMARY OF THE INVENTION

Keeping the above in mind, one object of the present invention is to provide an aquascooter having means to prevent hydrogen explosion, which otherwise, might be caused by igniting hydrogen-and-air mixture by spark appearing in electric motor, the hydrogen gas being produced and released from a battery or produced by electrolysis of seawater leaked into the aquascooter housing.

Another object of the present invention is to provide an aquascooter having simple, effective means to prevent a hydrogen explosion.

Another object of the present invention is to provide an aquascooter having means to detect a leak of seawater into its housing with high sensitivity.

Still another object of the present invention is to provide an aquascooter having means to inform a scubadiver of leak of seawater into its housing, thereby permitting him to take measures in avoiding hydrogen explosion.

Still another object of the present invention is to provide an aquascooter equipped with dual or triple safety means, thereby eliminating any possibility of hydrogen explosion.

Still another object of the present invention is to provide an aquascooter having means means to provide corrosion and damage of parts installed in housing.

Still another object of the present invention is to provide an aquascooter having means to allow easy carriage on land, and easy handling and operation in the water.

In order to attain these objects, an aquascooter which is designed for use by a scubadiver in scubadiving and other underwater activities, comprising at least, in a housing, a battery, a driving motor, and a clutch for engaging or disengaging the motor shaft to a propeller outside of the housing, are improved in the present invention, and is characterized in that it further comprises a water leak detecting sensor for detecting seawater leak into the housing, and a motor control reponsive to the signal from the water leak detecting sensor for preventing battery from supplying electric power to the driving motor, and thereby stopping the propeller.

The motor control is preferred to comprise: a power supply circuit extending from the battery to the driving motor and including a first relay switch; a motor driving circuit including a main switch for closing and opening the first relay switch in the power supply circuit, and a second relay switch; and a water leak sensor circuit including the water leak detecting sensor which is responsive to leak of water into the housing and providing a closed circuit, thereby opening the second relay switch to prevent electric current from flowing into the motor driving circuit, and opening the first relay switch to disconnect the power supply circuit from the battery, however keeping the second relay switch if no water is detected, thereby keeping the power supply circuit connected to the battery.

The water leak detecting sensor may be a piece of water absorbent cloth with positive and negative terminals at its opposite ends.

Still preferably, the aquascooter should include a water leak indicator for informing the scubadiver of water leak into the housing when the water leak detecting sensor detects the leak which opens the second relay switch and interrupts the motor driving circuit.

Also, the motor driving circuit is preferred to include at least one heat sensor in the housing. This responds to the temperature rise above a predetermined value, and interrupts the motor driving circuit which opens the first relay switch, and thereby disconnecting the motor from the battery. One heat sensor may be positioned in the vicinity of the battery, and another may be positioned in the vicinity of the driving motor.

The housing may have a first partition between the battery the the driving motor, and a second partition between the driving motor and the clutch, thus forming a battery compartment, a motor compartment, and a clutch compartment. These compartments are hermetically sealed. A battery housing defining the battery compartment, and a clutch housing defining the clutch compartment may be detachably connected to a motor housing defining the motor compartment. The water leak detecting sensor may be a piece of water absorbent cloth with positive and negative terminals at opposite ends, and it may be positioned with its positive and negative terminals on each opposite side of the first partition, thereby permitting detection of water leak into either battery or motor compartments.

One heat sensor may be positioned in the vicinity of the battery in the battery compartment, and another heat sensor may be positioned in the vicinity of the driving motor in the motor compartment.

The battery may be removably fixed in the battery compartment between holding means fixed to the first partition and another holding means fixed to the battery housing, thereby permitting the removal of the battery from the battery compartment for charging it exterior to the battery housing.

The battery casing is parallelepipedic, and preferably the holding means on the first partition may comprise a plurality of ribs integrally connected to the first partition. They are adapted to face and contact the four surfaces of the battery casing, which is in contact with the first partition. Another holding means is integrally connected to the battery housing. It comprises a bottom plate in contact with one bottom surface of the battery casing, and a plurality of ribs in contact with the four surfaces of the battery casing, which four surfaces are perpendicular to said one surface of the battery casing.

The main switch is fixed to the battery casing. It is an access switch comprising a switch button, a movable magnet which is adapted to move when the switch button is displaces to a start position, and a contact which is adapted to close under the influence of magnet when the switch button is displaced to the start position. The switch button appears on the housing surface, thus facilitating the operation of the access switch by the scubadiver. The contact is in the battery compartment, and is completely sealed to prevent appearance of spark in the battery compartment.

The battery and clutch compartments may have polymeric water absorbent stuffings.

The housing has a propeller shroud around the propeller, and the propeller shroud has a flat upper surface facing upward at the normal posture of the aquascooter in water.

Preferably, the housing may have handles at opposite sides of the battery housing, and a carrying handle at the front of the battery housing.

When the aquascooter housing leaks, water leak sensor detects leak of water into the housing to disconnect driving motor from the battery. Thus, the driving motor stops. Even if hydrogen is produced and released from the battery, or is produced by electrolysis of seawater until it is accumulated to the explosion limit, no hydrogen explosion will be caused because no spark can appear in the motor. Thus, breaking of parts in the housing and injury of the scubadiver by explosion can be prevented.

When the water leak sensor detects leak of water into the housing, the sensor provides a closed circuit to permit an electric current to flow, thereby causing the second relay switch to open. Then, the motor driving circuit is interrupted with the result that the power supply circuit disconnects the driving motor from the battery. Advantageously, the so constructed circuit arrangement is suitable for application in an aquascooter.

A piece of water absorbent cloth, which is of appropriate size, may be used as water leak sensor. Also, the water absorbent cloth when wet with seawater, will actuate the water leak indicator to inform the scubadiver of leak of seawater into the aquascooter. If heat sensors are included in the driving circuit, they will disconnect the driving motor from the battery to stop the driving motor when the the temperature of the battery of driving motor rises to the explosion limit. Thus, even if a flammable atmosphere should occur in the aquascooter housing, it cannot be ignited because of no spark in the driving motor. The aquascooter housing is composed of three separate housings each defining the battery compartment, the motor compartment and the clutch compartment. These compartments are made water tight, and therefore if the motor compartment or the clutch compartment should leak, seawater in these compartments cannot be subjected to electrlysis to generate hydrogen because of its isolation from the battery. Even if the battery compartment should leak, and if seawater is subjected to electrolysis to generate hydrogen enough to result in a flammable gas mixture, it cannot be ignited by spark appearing in the driving motor because the motor is isolated from the atmosphere of the battery housing. At an early stage prior to electrolysis of seawater in the battery compartment, the water leak sensor with its positive and negative terminals positioned in the battery and motor compartments, will detect seawater in either compartment to disconnect the driving motor from the battery, thus assuring safety.

The battery can be removed from the battery compartment, and it can be charged outside of the battery compartment. Therefore, even if hydrogen gas should be produced in charging the battery with electricity, the battery compartment will not be filled with flammable gas mixture.

In case that means for holding a battery detachably, consists of a battery holder fixed to the first partition 16 and a battery holder fixed to the battery housing, the battery can be easity fixed to the inside of the housing, and can be easily taken out of the battery compartment. The main switch is completely sealed, so when it is operated to start, no spark will appear in the battery compartment. This also, has an effect on prevention of hydrogen explosion.

High polymer water-absorbent stuffings are put in the clutch and battery compartments to absorb seawater leaked into these compartments, thus preventing corrosion and damage of mechanical parts installed therein.

The propeller shroud has a flat upper surface, and therefore the scubadiver can hold his body against the aquascooter underwater in a stable way. The aquascooter has carrying hadles at the front and opposite sides of the aquascooter body. On land the scubadiver can easily carry it with one hand gripping one of the side handles and the other hand gripping the front handle.

Other objects and advantages of the present invention will be better understood from the following descriptions in accordance with one embodiment of the present invention shown in the accompanying drawings.

Figure 5A:
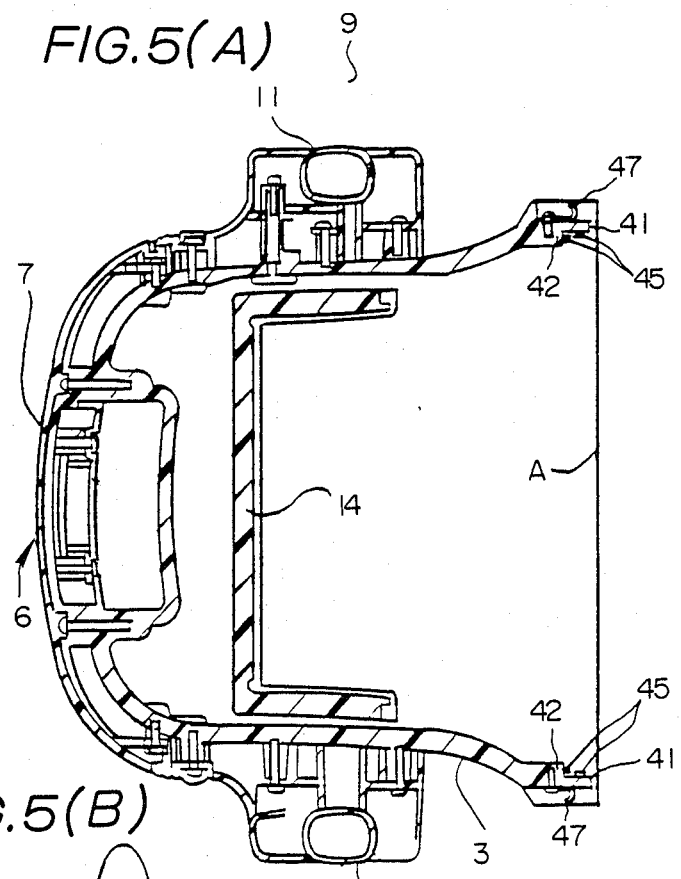
Figure 5B:
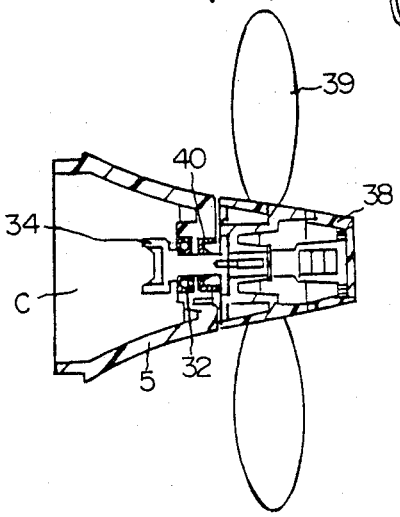
Figure 5C:
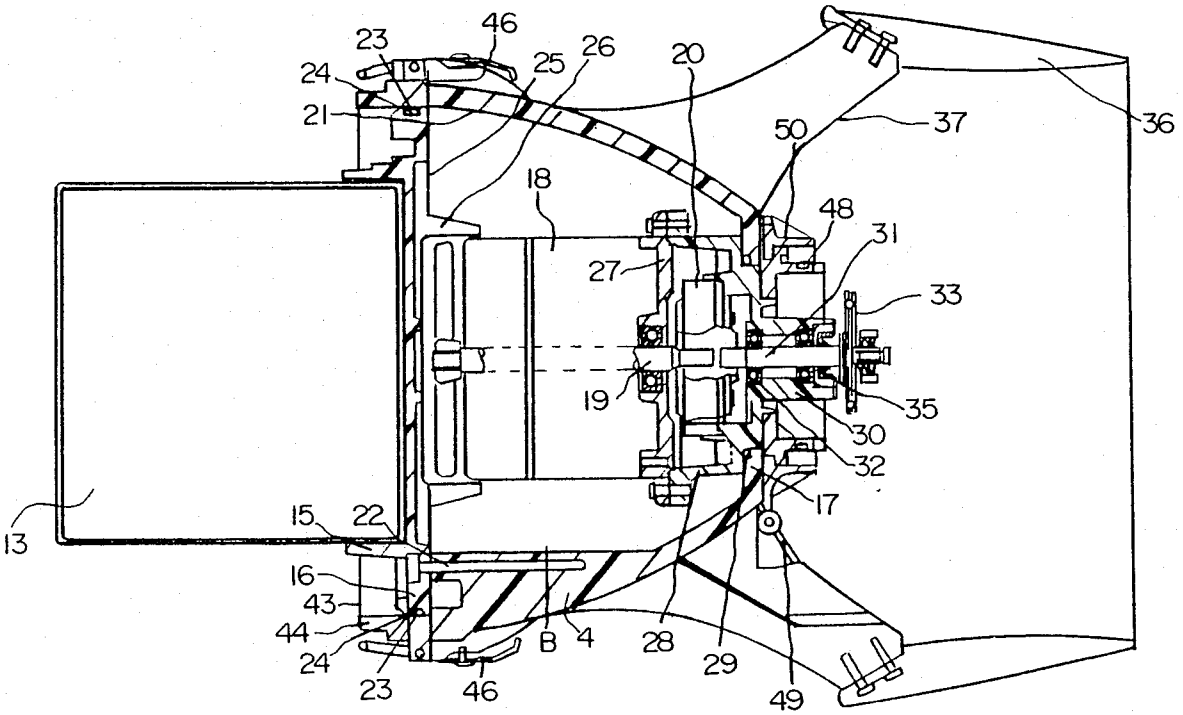
Figure 6:
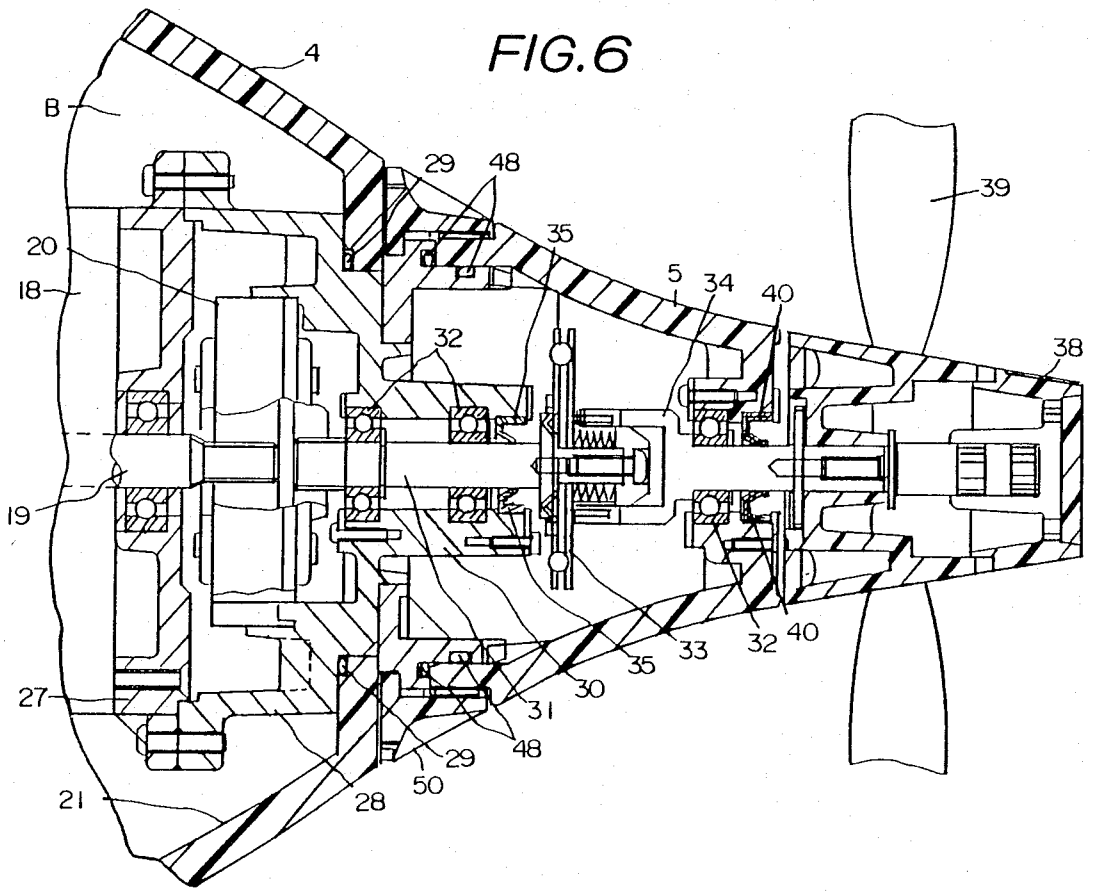
Figure 10:
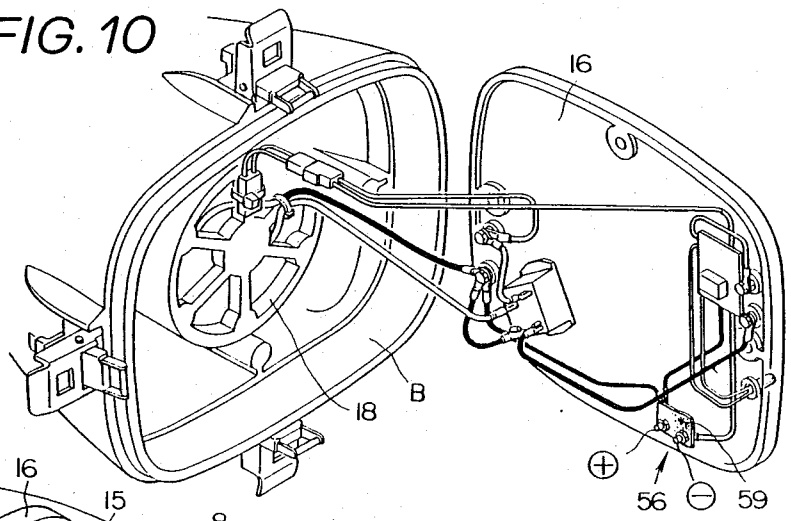
Figure 7:
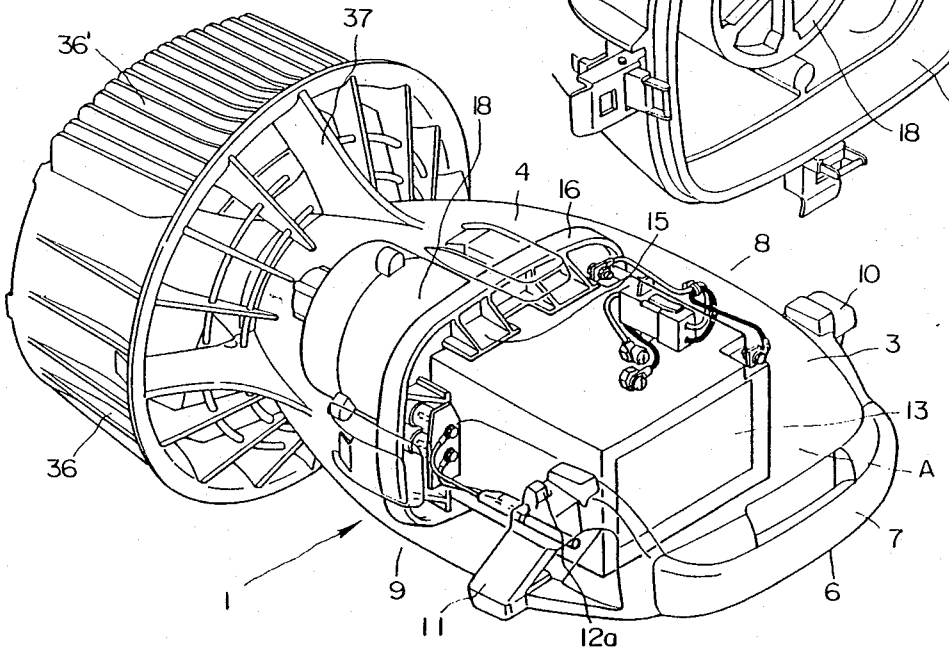
Figures 8, 9:
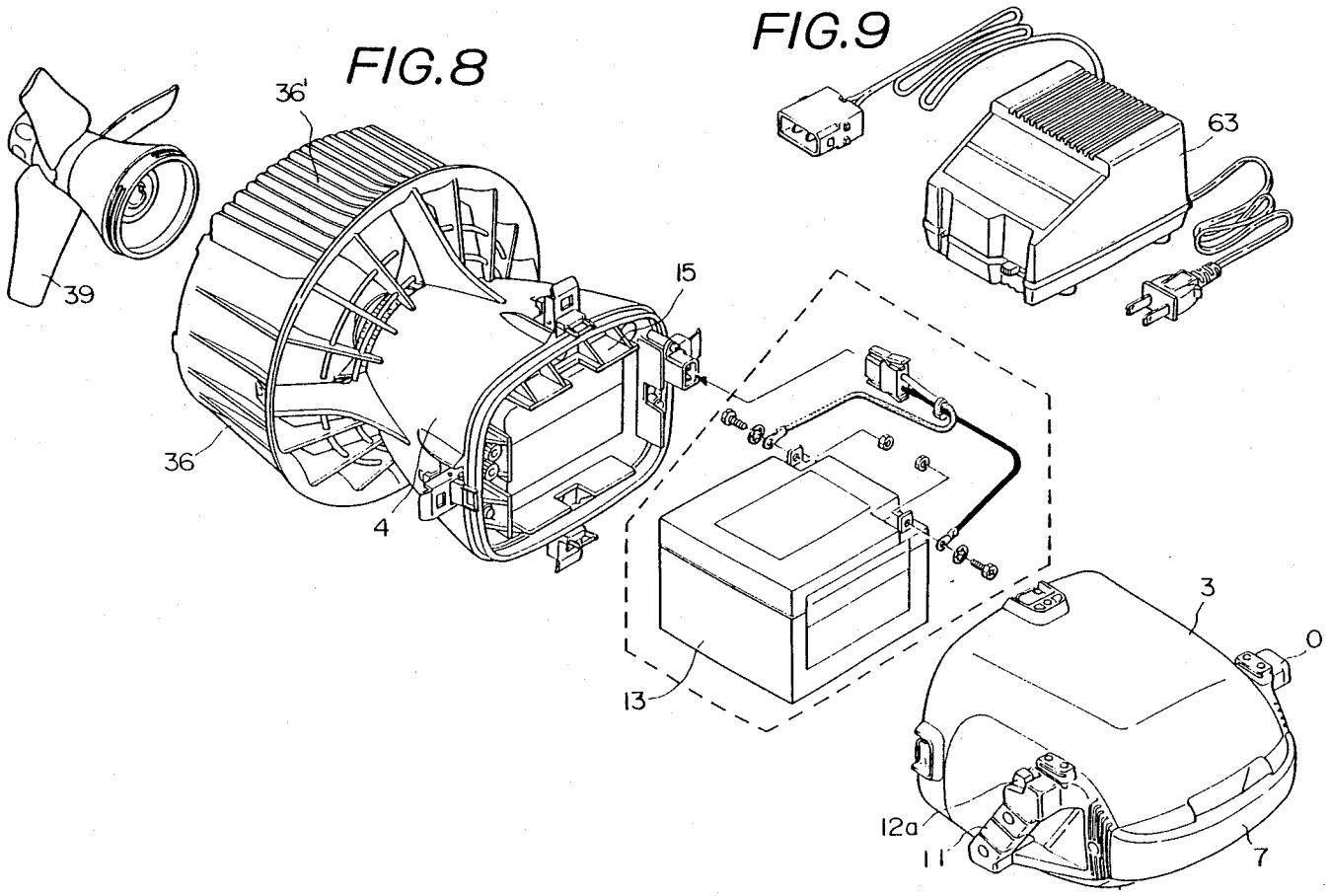
Figure 11:
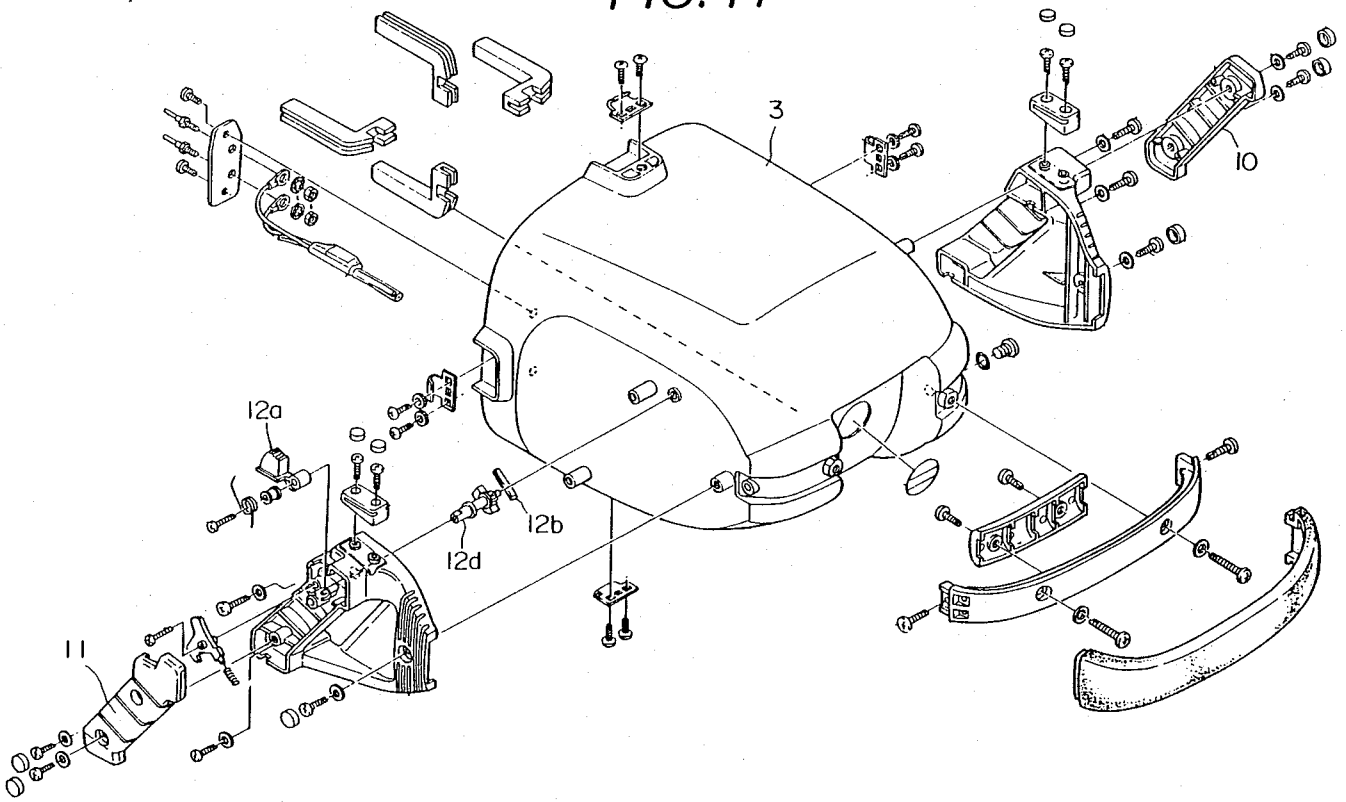

FIGS. 5A, B and C are longitudinal sections of different sections of the aquascooter;

FIG. 6 is a sectional view of the clutch compartment;

FIG. 7 is a perspective view of the aquascooter, showing the battery compartment with a battery installed therein;

FIG. 8 shows the battery removed from the battery compartment for charging with electricity;

FIG. 9 is a perspective view of the battery charging unit;

FIG. 10 shows a first partition and an associated water leak sensor;

FIG. 11 is a perspective view of the battery housing when disassembled; and

Figure 12:
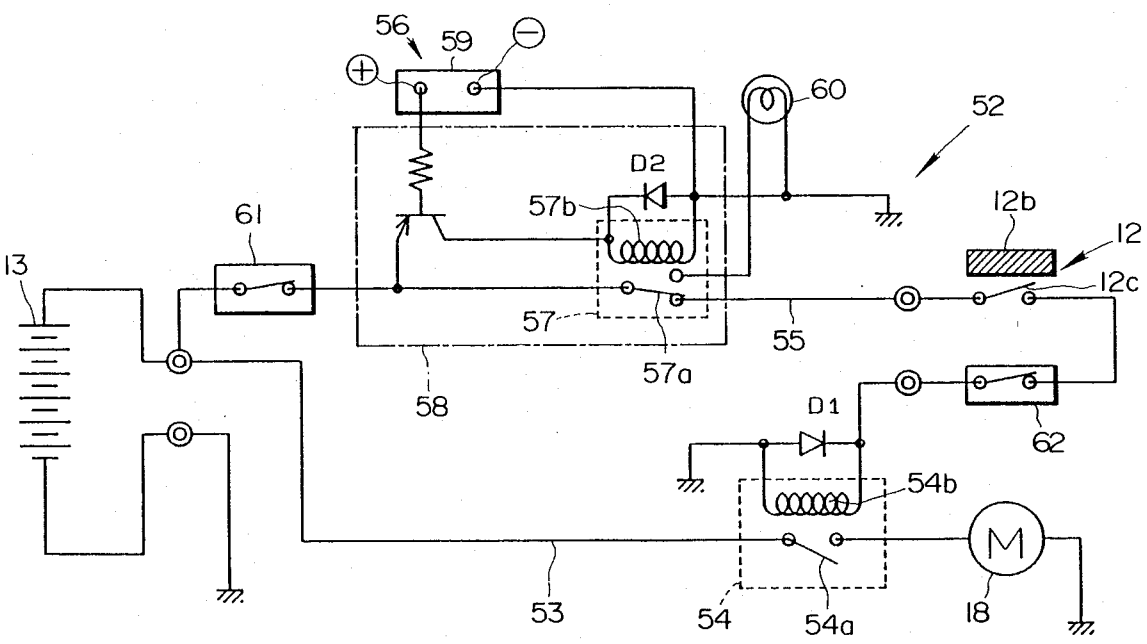

FIG. 12 is a circuit diagram showing a motor driving circuit including a water leak sensor, and a power supply circuit.

Referring to the drawings, first the mechanical parts of the aquascooter are described below.

An aquascooter is generally indicated at 1, and its housing 2 is composed of three divisions, that is, front, battery housing 3, intermediate, motor housing 4 and rear, clutch housing 5.

A bumper and carrying handle 7 are integrally connected to the top 6 of the battery housing 3. Left and right handles 10 and 11 are integrally connected to the opposite sides 8 and 9 of the battery housing 3. A main switch 12 is fixed to the right handle 11, functioning as a starter. The main switch will be later described in detail.

The battery housing 3 is smoothly convergent towards its top, and the aquascooter body has a generally streamlined shape, thereby reducing the resistance against seawater to a possible minimum.

A battery 13 is put in the battery compartment A, which is bordered by a first partition 16. Specifically, a battery holder 15 is fixed to the first partition 16, which separates the battery compartment A from the motor compartment B. Another battery holder 14 is fixed to the battery housing 3. The battery 13 is detachably held between these holders 14 and 15. When the battery requires charging, the battery housing 3 is separated from the motor housing B, and then the battery 13 is removed from the holders 14 and 15. As shown, the holder 15 comprises a plurality of ribs integrally connected to the first partition 16 for contacting the four surfaces of the battery casing perpendicular to one battery casing surface which is in contact with the first partition 16. The holder 14 is integrally connected to the battery housing 3, and comprises a bottom plate in contact with one surface of the battery casing and a plurality of ribs in contact with the four surfaces of the battery casing perpendicular to the one surface of the battery casing.

The motor compartment B is bordered by the first and second partitions 16 and 17. A DC motor 18 is installed in the motor compartment B. As shown, the motor 18 has a planetary gear 20 on its shaft 19 for speed reduction. The first partition 16 is fixed to the inside of the motor housing 4 by bolts 22. O-rings 24 are fixed to the circumference 23 of the first partition 16, and are pushed against the inner surface 21 of the motor housing 4, thereby preventing leakage of water into the motor or battery housing.

A motor holding frame 26 is integrally connected to one side 25 of the first partition 16. A motor stay 27 is fixed in the vicinity of the second partition 17, and a gear casing 28 is fixed to the motor stay 27 with bolts. O-rings 29 are put at places where the gear casing 28 and the second partition 17 abut on each other, thereby preventing leak of water between the motor compartment B and the clutch compartment C.

The gear casing 28 has a clutch shaft shroud 30 projecting into the clutch compartment C. A clutch shaft 31 is rotatably supported by bearings 32 in the clutch shaft shroud 30. One end of the clutch shaft 31 is connected to the planetarium gear 20, and the other end of the clutch shaft 31 is connected to the propeller shaft 34 via a clutch 33. A clutch shaft seal 35 is attached to the top recess of the clutch shaft shroud 30.

A propeller screen 37 and a propeller shroud 36 are fixed to the rear surface of the motor housing 4. The propeller shroud 36 has an upper flat surface 36'. When the aquascooter is put in the normal posture in water, the flat surface 36' of the propeller shroud 36 faces upwards, and therefore a scubadiver can easily hold his body against the aquascooter body, and therefore he can easily handle and operate the aquascooter in water.

The clutch compartment C is bordered by the second partition 17, and is defined by the clutch housing 5. The propeller shaft 34 is rotatably fixed to the clutch housing 5 by bearing 32. The end of the propeller shaft 34 is in the form of hollow cylinder. This hollow cylinder snugly receives the rear end of the clutch shaft 31. A propeller pitch adjuster or speed control dial 38 is attached to the rear end of the clutch housing 5. A plurality of blades 39 are rotatably fixed to the propeller pitch adjuster 38.

The propeller shaft 34 has a seal 40 at the end of the clutch housing 5, thereby preventing the leak of seawater into the clutch compartment C when the propeller rotates.

When the battery housing 3, motor housing 4 and clutch housing 5 are connected together, first, the staggered annular edge 42 of the open end 41 of the battery housing 3 is fitted to the complementary staggered annular edge 44 of the closed end 43 of the motor housing 4. The open end ridge 44 of the motor housing 4 has two o-rings 45 at its abutment surfaces, thereby hermetically sealing the joint between the battery housing 3 and the motor housing 4. The motor housing 4 has four locking buckles 46 on its circumference at intervals of 90 degrees, and the battery housing 3 has four locking hooks 47 on its circumference at corresponding angular positions. These locking buckles 46 are locked hermetically to joint the battery and motor housings together. Next, the motor housing 4 and the clutch housing 5 are jointed together by fastening their locking buckles. Then, they are jointed hermetically with o-rings 48 compressed therebetween.

The battery, motor and clutch housings may be made of ABS resin or any other appropriate synthetic resin.

The circumference of the first partition 16 as an O-ring 24 and sealant 49 against the inner surface 25 of the motor housing 4, thereby preventing seawater from leaking into the motor compartment B even if seawater should leak into the battery compartment A.

A bayonet coupling system is employed in the joint between the motor housing 4 and the clutch housing 5. Therefore, they can be easily separated by lifting the locking buckles 49 and rotating clamp ring 50 anticlockwise.

The propeller shaft seal 40 described above is of such a double construction as will minimize leak of seawater into the clutch compartment under seawater pressure while the propeller rotates in the water.

Preferably, sheets of polymeric material may be put in the battery and clutch compartments A and C, thereby absorbing seawater even if these compartments should leak seawater, and preventing the mechanical parts from being exposed to seawater. Such water absorbing sheets may be stuffed around mechanical parts in these compartments.

The aquascooter is equipped with a motor control 52, which constitutes the main feature of the present invention. It is sensitive to a leak of seawater into the battery or motor compartment for disconnecting the motor 18 from the battery 13, thus stopping the motor.

FIG. 12 shows one example of the motor control circuit 52. As shown, it includes a power supply circuit 53 connecting the drive motor 18 to the battery 13 and including a first relay switch 54, and a motor driving circuit 55 having a second relay switch 57 and a main switch 12 for opening and closing the first relay switch 54 in the power supply circuit. Also, it includes a water leak sensor circuit 58. The circuit includes a water leak sensor 56. The first relay switch 54 is kept closed to connect the drive motor 18 to the battery 13. The first relay switch 54 comprises an opening-and-closing contact **54*a* and a solenoid 54*b*. Likewise, the second relay switch 57 comprises an opening-and-closing contact 57*a* and a solenoid 57*b*. The water leak sensor 56 is responsive to leak of seawater into the battery or motor compartment for closing or providing a closed circuit, thereby causing the second relay switch 57 to open in the motor driving circuit 55. Thus, the first relay switch 54 is deenergized to disconnect the drive motor 18 from the battery 13. When no seawater is detected, the water leak sensor 56 remains open, keeping the relay switch 57 closed to permit an electric current to flow in the motor driving circuit 55. The water leak sensor 56 may be a piece of water absorbent cloth 59 with positive and negative terminals on its opposite sides. The water leak sensor 56 is put with its positive and negative terminals on either side of the first partition 16 in the battery and motor compartments A and B, respectively. The water absorbent cloth is laid under the partition 16** to permit detection of leak of seawater at an early stage.

The water leak sensor circuit 58 is connected to a leak warning circuit including a water leak indicator 60. Specifically, the water leak indicator 60 is connected to the second relay switch 57 in such a way that the indicator 60 is connected to the battery 13 through the second relay switch 57 when the switch 57 is attracted to the solenoid **57*b* to open the motor driving circuit 55 at the time of detection of water leak. The indicator 60** is a lamp, which is fixed to the scooter body at a place where the scubadiver can see it easily. The lamp is encapsulated and hermetically sealed.

As shown, the motor driving circuit 55 has two series-connected heat sensors 61 and 62. One heat sensor 61 is put in the battery compartment, and the other heat sensor 62 is put in the motor compartment B. These heat sensors are essentially temperature sensitive switches. They are sensitive to the rise of temperature in these compartments for interrupting the motor driving circuit to disconnect the motor from the battery 13, thus preventing hydrogen gas increasingly produced from the battery at a rising temperature. The heat sensors are set to operate at the upper limit of the predetermined safety range.

Figure 1:
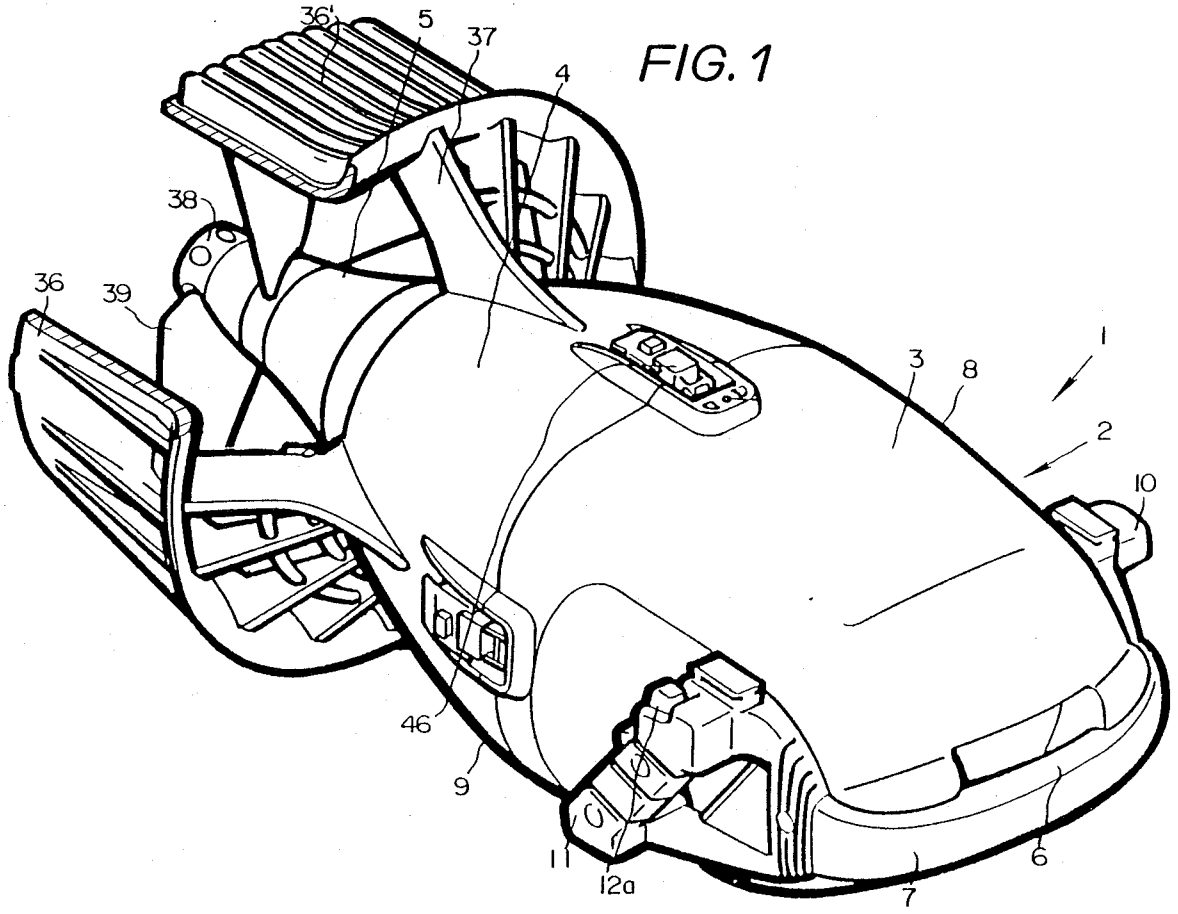
FIG. 1 is a perspective view of an aquascooter according to one embodiment of the present invention.

The main switch 12 will be described in detail. The main switch 12 is fixed to the battery housing 3. It is an access switch, which comprises a switch button **12*a*, a movable magnet 12*b* and a contact 12*c*. When the switch button 12*a* is displaced to start position, the magnet 12*b* will be displaced to start position, thereby causing the contact 12*c* to close under the influence of the magnet put in start position. As shown in FIG. 1, the switch button 12*a* appears on the right handle 11 for easy operation by the scubadiver, and the contact 12*c* is located in the battery compartment. The contact 12*c*** is encapsulated to prevent a spark from appearing in the battery compartment.

When the switch button **12*a* is depressed, its pivot 12*c* rotates to move the magnet 12*b* to the "on" position where the magnet 12*b* is close enough to cause the contact 12*c* to close. When the switch button 12*a*** is released, it will resiliently return to its original position.

Figure 3A:
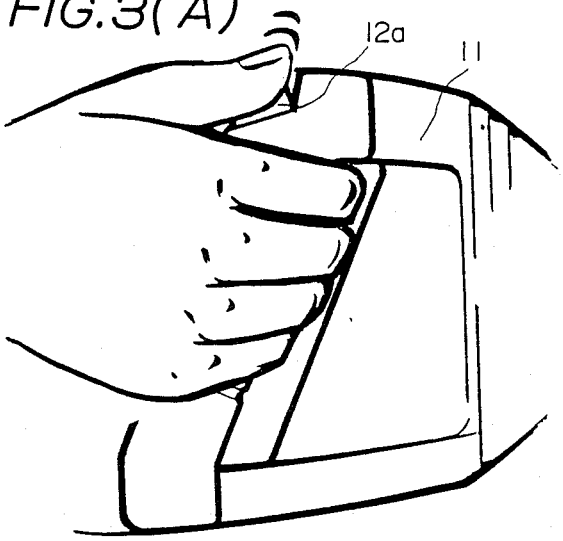
FIG. 3A shows the manner in which the main switch is depressed.
Figure 3:
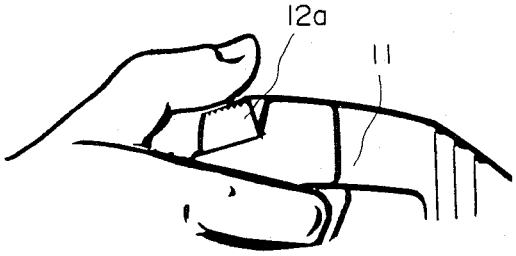
FIG. 3B shows the manner in which the main switch is released.
Figure 4:
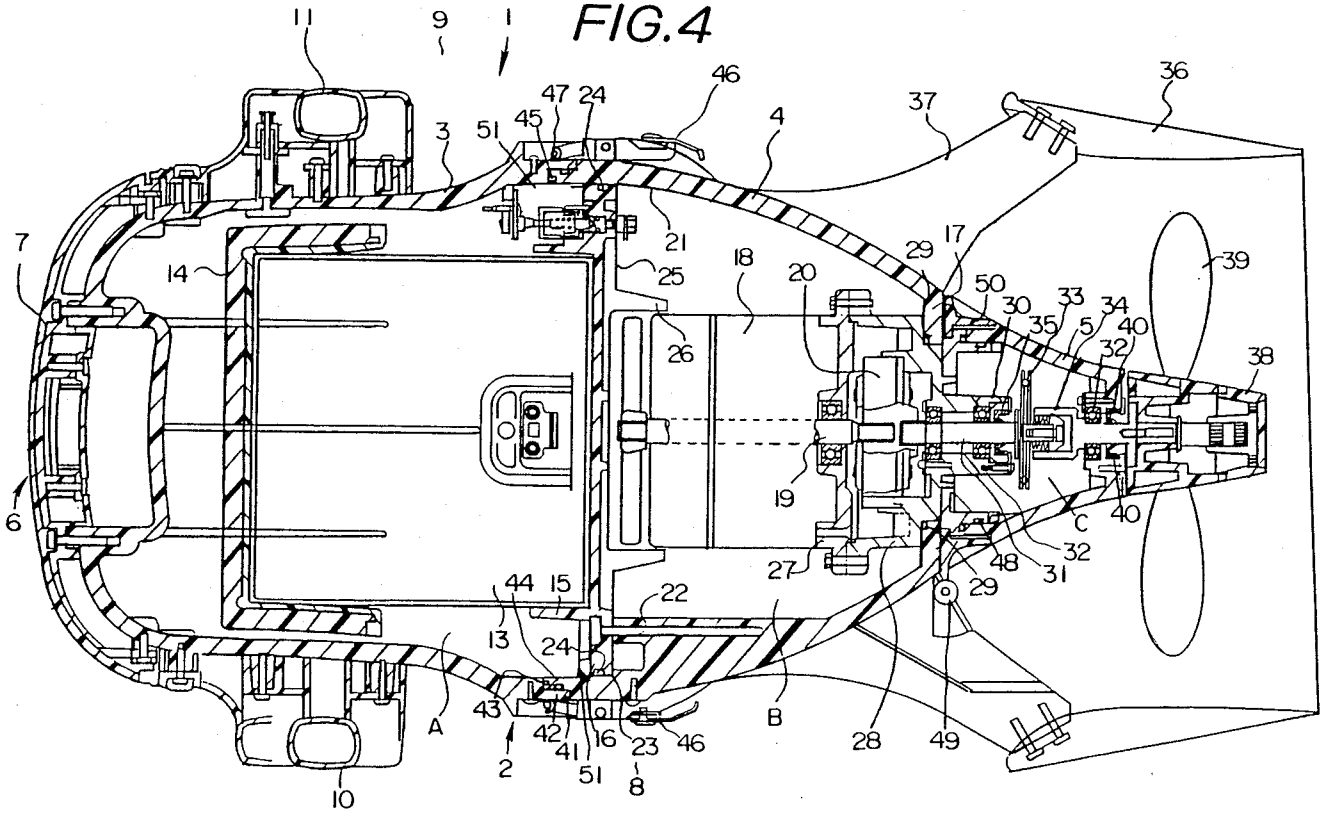
FIG. 4 is a longitudinal section of the aquascooter.

The scubadiver can use an aquascooter according to the present invention in an ordinary way in water. First, he depresses the switch button **12*a* as shown in FIG. 3(A) (FIG. 3(B) shows that the switch button 12*a* is released to return to its original position). When the switch button 12*a* is depressed, the magnet 12*b* is rotated to start position. Then, the magnet 12*b* is put close enough to cause the contac 12*c* to close. Thus, the motor driving circuit 55 in FIG. 12 is closed to energize the solenoid 54*b* of the first relay switch 54. Then, the contact 54*a* of the first relay switch 54 is closed, thereby connecting the motor 18 to the battery 13 in the power supply circuit 53. The torque is transmitted from the motor shaft 19 to the propeller 39 via the clutch shaft 31, clutch 33 and propeller shaft 34** to drive the aquascooter forward in the water.

As described earlier, the contact **12*c* of the main switch 12 is encapsulated, and therefore no spark will appear in the battery compartment A. Even if the atmosphere in the battery compartment A should be flammable, no explosion could be caused. In carrying the aquascooter on land, the scubadiver can hold it with one hand gripping the front handle 7 and the other hand gripping right handle 10 or left handle 11**. When two persons carry it on land, each of them stands on each side of the aquascooter, holding it with one hand gripping right or left handle.

Figure 2:
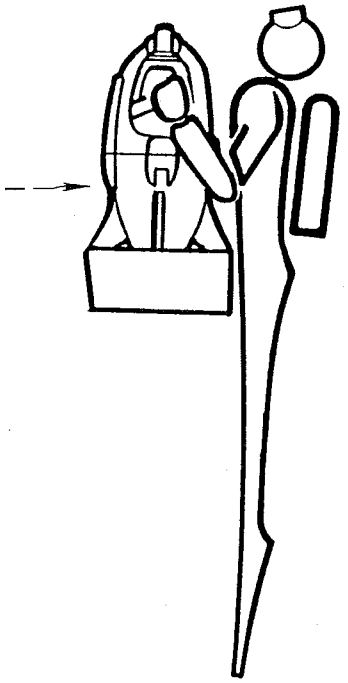
FIG. 2 shows a scobadiver and his aquascooter in water.

As shown in FIG. 2, the scubadiver can hold his body against the upper flat surface 36' of the propeller shroud 36 in water in a stable, balanced condition, and therefore he can drive his scooter with ease.

Even if the scooter housing should leak seawater, the polymeric material will absorb the seawater, thus preventing the mechanical parts of the battery and clutch compartments A and C from being wet.

Now, detection of leak of seawater into the aquascooter housing is described. Assume that the battery and/or motor compatment leaks seawater. Then, the water absorbent cloth 56 will get wet. Then, its positive and negative terminals will be shortcircuited, tus turning an associated transistor switch on. As a result the solenoid **57*b* of the second relay switch 57 is energized to open its contact 57*a*, thus preventing an electric current from flowing in the motor driving circuit 55. On the other hand the water leak warning lamp 60 is lit to warm the scubadiver of the leak of seawater into the scooter housing. When the motor driving circuit 55 is interrupted, the solenoid 54*b* of the first relay switch 54 is deenergized to open its contact 54*a* and hence, interrupts the power supply circuit 54. Then, the motor 18** stops. Even if the battery and/or motor compartments should leak seawater to generate a relatiely large amound of hydrogen gas by electrolysis of seawater, no explosion can be triggered by spark, which does not generate in the motor while it is stopped.

As already referred to, one heat sensor 61 is located in the battery compartment A whereas another heat sensor is located in the motor compartment B. When the atmospheric temperature in these compartments rises above a predetermined temperature, they will interrupt the motor driving circuit 55 to disconnect the motor from the battery 13. Thus, even if hydrogen gas is produced and released from the battery at an increased temperature, the explosion will be prevented.

In charging the battery, first, the battery housing 3 is separated, and then removed from the battery holder 14. Next, the battery 13 is removed from the battery holder 15, and then taken out of the battery housing 3 for charging. Hydrogen gas is likely to be produced at the termination of charging, or when overcharged. As shown in FIG. 8, the battery 13 is taken out of the battery housing 3, and is charged with a battery charger 63 in an open atmosphere. Therefore, there is no fear of explosion which is caused by leakage and accumulation of hydrogen gas in the closed space during charging.

The conventional aquascooter has a propeller shaft hermetically sealed at one place, and therefore a small amount of seawater often leaks into the scooter housing through this single seal when the propeller rotates in the water. Also, the conventional scooter housing has no bulkheads to permit separate installation of the battery, motor and clutch. Therefore, once the seawater leaks into the scooter housing throught propeller shaft seal, the housing becomes soaked with saltwater, following initial leakage. Thus, corrosion and damge of motor result.

As described earlier, in an aquascooter according to the present invention, its housing is divided into three compatments by the partition bulkheads, and the motor is installed in the intermediate compartment, thus minimizing the possibility of being soaked with seawater.

The propeller shaft 34 is double sealed with propeller shaft seal 40, and the clutch shaft 31 is sealed with clutch shaft seal 35. Therefore, even if the clutch housing should leak seawater through propeller shaft seal 40, the clutch shaft seal 35 and the second partition bulkhead 17 will prevent leak of seawater into the motor compartment C. Also, even if the battery housing 3 should leak, the first partition bulkhead 16, which is hermetically sealed with O-rings 24 and sealant 51, will prevent leak into the motor compartment B. Thus, the battery and clutch compartments have a sealing effect on the motor compartment, which is sandwiched between the battery and clutch compartments. Each end of the compartments is double sealed, and therefore, even if it should leak saltwater, it seldom allows saltwater to leak into the adjacent compartment.

The aquascooter can submerge fifty or more meters in water. The water pressure on the aquascooter will increase with the increase of submerging depth, and it is difficult to prevent leak of seawater into the aquascooter housing. The aquascooter housing is so constructed that seawater cannot start leakage into the motor compartment through the clutch shaft seal 35 before filling the clutch compartment. The clutch shaft seal 35 has a liquid tightness enough to prevent leak of seawater into the motor compartment, and such sealing is much easier than would be required when subjected directly to outer seawater pressure.

The clutch housing 5 can be removed easily by rotating the clump ring 50, thereby emptying out the seawater from the clutch compartment C.

As described above, division of the aquascooter housing into three separate, water-tight compartments, and installation of the motor in the intermediate compartment are effective in localizing leak of seawater in each end compartment, thereby preventing leak into the motor compartment.

Also, separation of the aquascooter housing into three sections facilitates charging of the battery and maintenance work. Accordingly, defects and malfunctions if any, will be found easily, compared with the conventional aquascooter having a single, unseparated housing. Thus, the safety in scubadiving can be increasingly assured.

An aquascooter according to the present invention provides many advantages as follows:

An aquascooter according to claim 1 is guaranteed free of spark ignition and explosion of hydrogen gas. It may be generated from the battery of by electrolysis of seawater which leaks into the scooter housing. Also, corrosion and damage of mechanical parts of the aquascooter can be prevented.

An aquascooter according to claim 2 has simple means for preventing explosion of hydrogen.

An aquascooter according to claim 3 uses a water leak sensor in the form of a piece of water absorbent cloth. In can detect leak of seawater at an increased sensitivity.

An aquascooter according to claim 4 has a water leak warning means, thereby informing the scubadiver of the possible hydrogen explosion.

An aquascooter according to claim 5 uses heat sensors which are responsive to temperature rise of the battery and motor compartment above a predetermined temperature for stopping the motor, thereby preventing the spark ignition of flammable gas, if any. The probability with which the explosion of hydrogen gas is caused, will increase with the rise of compartment temperature. In view of this, heat sensors are used to assure safety. An aquascooter according to claim 6 has heat sensors each located in the vicinity of the battery and the drive motor. Thus, safety is assured by covering all temperature rising areas.

An aquascooter according to claim 7 uses three divisional housing, which can be hermetically joined together. Thus, the leak of seawater will be localized, preventing leak of seawater into the adjacent compartment, and minimizing corrosion and damage of the mechanical parts. Also, the motor will be stopped in response to detection of the leak of seawater into the battery and motor compartments, thereby assuring safety.

An aquascooter according to claim 8 has heat sensors each located in the battery and motor compartments, thereby preventing the explosion of hydrogen which may be expedited by rising temperature.

An aquascooter according to claim 9 has a battery detachably mounted in its housing, thereby permitting removal of the battery for charging outside. Thus, even if hydrogen gas should be produced and leaking from the battery in charging, it cannot be accumulated in a closed space, and accordingly one cause of explosion is eliminated.

An aquascooter according to claim 10 has simple means for detachably holding a battery.

An aquascooter according to claim 11 has means for preventing appearance of spark from a main switch in the battery compartment, in which there can be flammable gas.

An aquascooter according to claim 12 has water absorbent material stuffed in its battery and clutch compartments, thereby preventing mechanical parts from being soaked with seawater. Thus, no corrosion will result.

An aquascooter according to claim 13 permits the scubadiver to hold his body against the scooter body in a balanced condition, thus facilitating its handling and operation.

An aquascooter according to claim 14 is easy to carry on land.

What is claimed is:

1. A controller for an aquascooter of the type that has, in a housing, a battery, a driving motor and a shaft, and a clutch for engaging or disengaging the shaft to a propeller outside of the housing, said controller comprising a water leak detecting sensor for detecting a leakage of water into the housing; and a motor control responsive to the signal from the water leak detecting sensor for preventing the battery from supplying electric power to the driving motor, thereby stopping driving the propeller.

2. A controller according to claim 1 wherein the motor control comprises:

a power supply circuit extending from the battery to the driving motor and including a first relay switch; a motor driving circuit including a main switch for closing or opening the first relay switch in the power supply circuit, and a second relay switch; and a water leak sensor circuit including a water leak detecting sensor which is responsive to a leakage of water into the housing for providing a closed circuit, thereby opening the second relay switch to prevent electric current from flowing in the motor driving circuit, thereby opening the first relay switch to disconnect the power supply circuit from the battery, while no water is detected the second relay switch being kept closed, thereby permitting electric current to flow in the motor driving circuit, thereby keeping the power supply circuit connected to the battery.

3. A controller according to claim 2 wherein the water leak detecting sensor is a piece of water absorbent cloth with positive and negative terminals at its opposite ends.

4. A controller according to claim 2 wherein it further comprises a water leak indicator for informing a scubadiver of leakage of water into the housing when the water leak detecting sensor detects a leakage of water to cause the second relay switch to open in the motor driving circuit.

5. A controller according to claim 2 wherein the motor driving circuit includes at least one heat sensor which is responsive to the rise of temperature above a predetermined value within the housing for opening the motor driving circuit to cause the first relay switch to open, thereby disconnecting the power supply circuit from the battery.

6. A controller according to claim 5 wherein one heat sensor is positioned in the vicinity of the battery and another heat sensor is positioned in the vicinity of the driving motor.

7. A controller according to claim 6 wherein said one heat sensor is positioned in the vicinity of the battery in the battery compartment and said another heat sensor is positioned in the vicinity of the driving motor in the motor compartment.

8. A controller according to claim 2 wherein said main switch is fixed to the battery casing, and is an access switch comprising a switch button, a movable magnet which is adapted to move when the switch button is displaced to a start position, and a contact which is adapted to close under the influence of the magnet when the switch button is displaced to the start position, the switch button appearing on the housing surface, thus facilitating the operation of the access switch by the scubadiver, the contact being in the battery compartment, and being completely sealed to prevent appearance of a spark in the battery compartment.

9. A controller according to claim 1 whereint he housing has a first partition between the battery and the driving motor, and a second partition between the driving motor and the clutch, thus forming a battery compartment a motor compartment and a clutch compartment these compartments being hermetically sealed, and a battery housing defining the battery compartment and a clutch housing defining the clutch compartment being detachably connected to a motor housing defining the motor compartment, the water leak detecting sensor being a piece of water absorbent cloth with positive and negative terminals at its opposite ends, and the water absorbent cloth being positioned with its positive and negative terminals on each opposite side of the first partition, thereby permitting detection of water leakage into either of the battery and motor compartments.

10. A controller according to claim 9 wherein the battery is removably fixed in the battery compartment between holding means on the first partition and battery casing holding means, thereby permitting the removal of the battery from the battery compartment for charging the battery exterior to the housing.

11. A controller according to claim 10 wherein said battery casing is parallelepipedic, and said holding means on the first partition comprises a plurality of ribs integrally connected to the first partition for facing and contacting the four surfaces of the battery casing which four surfaces are perpendicular to one battery casing surface which is in contact with the first partition, and said battery casing holding means being integrally connected to the battery housing and comprising a bottom plate in contact with one surface of the battery casing and a plurality of ribs in contact with the four surfaces of the battery casing, which four surfaces are perpendicular to said one surface of the battery casing.

12. A controller according to claim 9 wherein said battery and clutch compartments each have a polymeric water absorbent stuffed therein.

13. A controller according to claim 9 wherein said housing includes a propeller shroud around the propeller, the propeller shroud having a flat upper surface facing upward at the normal posture of the aquascooter in water.

14. A controller according to claim 9 wherein said housing has handles at opposite sides of the battery housing, and a carrying handle at the front of the battery housing.

* * * * *